US006755751B2

(12) United States Patent
Chapman

(10) Patent No.: US 6,755,751 B2
(45) Date of Patent: Jun. 29, 2004

(54) PUTTING TRAINER DEVICE AND METHOD

(76) Inventor: Christopher Ray Chapman, 685 Darnell Rd., Jefferson, GA (US) 30549

( * ) Notice: Subject to any disclaimer, the term of this patent is extended or adjusted under 35 U.S.C. 154(b) by 0 days.

(21) Appl. No.: 10/146,829

(22) Filed: May 15, 2002

(65) Prior Publication Data

US 2002/0173370 A1 Nov. 21, 2002

Related U.S. Application Data

(60) Provisional application No. 60/291,535, filed on May 15, 2001.

(51) Int. Cl.[7] ..... A63B 57/00; A63B 69/36; A63B 53/06; A63B 53/16

(52) U.S. Cl. ..... 473/229; 473/261; 473/268; 473/270; 473/258

(58) Field of Search ..... 473/261, 263, 473/265, 266, 268, 257, 210, 264, 277, 258, 270, 271, 272, 273, 452, 262; 482/15, 16, 17, 35; D21/791, 792, 789, 793; 33/508, 289; 248/353; 211/119.01; D32/58

(56) References Cited

U.S. PATENT DOCUMENTS 2,303,736 A 12/1942 Hall
3,656,752 A * 4/1972 Moriarty ..... 473/261
3,806,133 A 4/1974 Cork
4,133,535 A 1/1979 Marsh
4,869,510 A 9/1989 Battersby
4,928,975 A 5/1990 Skelley et al.
4,998,731 A * 3/1991 Bowen ..... 473/271
5,527,041 A 6/1996 Terry, III et al.
5,551,695 A 9/1996 Wolk
5,595,543 A 1/1997 Wolk
5,769,732 A * 6/1998 O'Neal ..... 473/258
5,816,417 A * 10/1998 Reaves ..... 211/119.01
5,913,732 A 6/1999 Kwakkel
6,048,273 A 4/2000 Clement
6,129,639 A 10/2000 Brock et al.
6,458,041 B1 * 10/2002 Brandt ..... 473/268

* cited by examiner

*Primary Examiner*—Stephen P. Garbe
*Assistant Examiner*—Alvin A. Hunter, Jr.
(74) *Attorney, Agent, or Firm*—Hinkle + O'Bradovich, LLC

(57) ABSTRACT

An apparatus for improving a golfer's putting stroke along a line of intended travel of a golf ball. The apparatus enables the golfer to practice positioning his or hear head and feet in selected positions with respect to the golf ball and the line of intended ball travel, as well as the desired positioning of the putter, at the address position. The golfer can also practice the motion of the putting stroke according to either a "straight back/straight through" or "inside the line" stroke motion.

16 Claims, 6 Drawing Sheets

PUTTING TRAINER DEVICE AND METHOD

CROSS REFERENCE TO RELATED APPLICATIONS

This application claims priority to U.S. Provisional Application 60/291,535, filed May 15, 2001, which application is hereby incorporated by this reference in its entirety.

BACKGROUND OF THE INVENTION

1. Field of the Invention

The present invention relates to a training device and method for practicing and improving skills in the game of golf. Specifically, the invention relates to putting, and to a device and method for training proper alignment and motion of the putter as well as proper head, foot and club positioning during the putting stroke.

2. Background Art

The game of golf is played by millions of people worldwide spanning all skill levels from beginner to expert. For most golfers, a great deal of practice is required to advance one's skills. For many, a great deal of practice is required simply to maintain one's current skill level. Throughout a round of golf, shots of varying distances are required, for which different golf clubs are used. A large subset, often more than half, of a golfer's shots during any given round are hit with the putter, which is the golf club specially designed for use on or around the putting green. The golfer's putting stroke is therefore an important part of the golfer's game. Consequently, many golfers spend a great deal of time practicing their putting stroke.

Because of the popularity of the game and the need for intensive practice, many training devices exist to assist the player with developing and maintaining proper form in the golf swing, and specifically the putting stroke. A need exists, however, for a training device and method directed to training the golfer to maintain a desired alignment between the putter and the target throughout the putting stroke. Additionally, a need exists for a training device and method for teaching proper alignment and positioning of the feet, head and golf club during the putting stroke.

SUMMARY OF THE INVENTION

In accordance with the invention, as embodied and described herein, this invention, in one aspect, relates to an apparatus for improving a golf stroke along a line of intended travel of a golf ball by aligning a user's eyes at an eye location point above the apparatus within a vertical plane that includes the golf ball and the line of intended travel. In this aspect, the invention includes a frame structure having a first support leg and a second support leg spaced from the first support leg. An eye alignment device, which is supported by the frame structure, includes a substantially linear top edge portion that is visible when viewed from the eye location point, and a tail portion spaced from the top edge portion and located within the same vertical plane as the top edge portion. When the user's eyes are located within the vertical plane, the tail portion is obscured from view by the top edge portion, thus indicating that the user's head is correctly aligned.

In another aspect, the invention relates to an apparatus for improving a golf stroke by aligning a heel portion of a putter along a desired stroke plane that includes a horizontal line that is parallel to the line of intended travel of a golf ball along the ground. In this aspect, the invention includes a frame structure having a first support leg and a second support leg spaced from the first support leg. A putter alignment member, which is supported by the frame structure, has a first end affixed to the first support leg, a spaced second end affixed to the second support leg, and a substantially planar contact face for contacting the heel of the putter head. The contact face is oriented so that a horizontal line extending along the contact face is parallel to the line of intended travel of the golf ball. When the heel portion of the putter head is moved back and forth in a putting motion with the heel portion in contact with the contact face, the heel portion moves within a plane that is parallel to the contact face.

In yet another aspect, the invention relates to an apparatus for improving a golf stroke by allowing a golfer to align their feet with an intended line of travel of a golf ball along the ground. In this aspect, the invention includes a frame structure having a first support leg and a second support leg spaced from the first support leg. A stance alignment device, which is supported by the frame structure, includes a substantially linear foot reference indicator that is substantially parallel to the line of intended travel of the golf ball. The foot reference indicator extends between the first support leg and the second support leg of the frame structure.

In another aspect, the invention relates to an apparatus for improving a golf stroke by imparting a force to a putter having a putter head and a connection location, the apparatus tending to maintain the putter head along a line of intended travel of a golf ball when the putter head is moved back and forth in a putting motion. In this aspect, the invention includes a frame structure having a first support leg attached to a first base member, and a second support leg spaced from the first support leg and attached to a second base member. A stroke resistance device, which is supported by the frame structure, includes a first resistance component and a second resistance component. The first resistance component has a fixed end and a variable end spaced from the fixed end, the fixed end being connected to the first base member at a first fixed point and the variable end being connected to the putter at the connection location. The second resistance component also has a fixed end and a variable end spaced from the fixed end, the fixed end being connected to the second base member at a second fixed point and the variable end being connected to the putter at the connection location. When the putter head is moved back and forth in the putting motion generally between the first fixed point and the second fixed point, at least one of the first or second resistance components imparts a tensile force to the putter head toward the respective first or second fixed points.

In a further aspect, the invention relates to an apparatus for improving a golf stroke along a line of intended travel of a golf ball by positioning a putter, the putter having a putter shaft connected to a putter head with a heel portion and a sole surface, so that the sole surface lies substantially flat upon the ground. In this aspect, the invention includes a frame structure having a first support leg and a second support leg spaced from the first support leg. A putter alignment member, which is supported by the frame structure, defines a substantially planar contact face oriented so that a horizontal line extending along the contact face is substantially parallel to the line of intended travel. A substantially linear shaft alignment device, which is also supported by the frame structure, is oriented substantially parallel to the line of intended travel. The shaft alignment device is attached to the frame structure at a selected location so that when the heel portion of the putter head is in contact with the contact face and the putter shaft is in contact with the shaft alignment device, the sole surface of the putter head lies substantially flat upon the ground.

Additional aspects of the invention are forth in the description which follows, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION OF THE INVENTION

Figure 1:
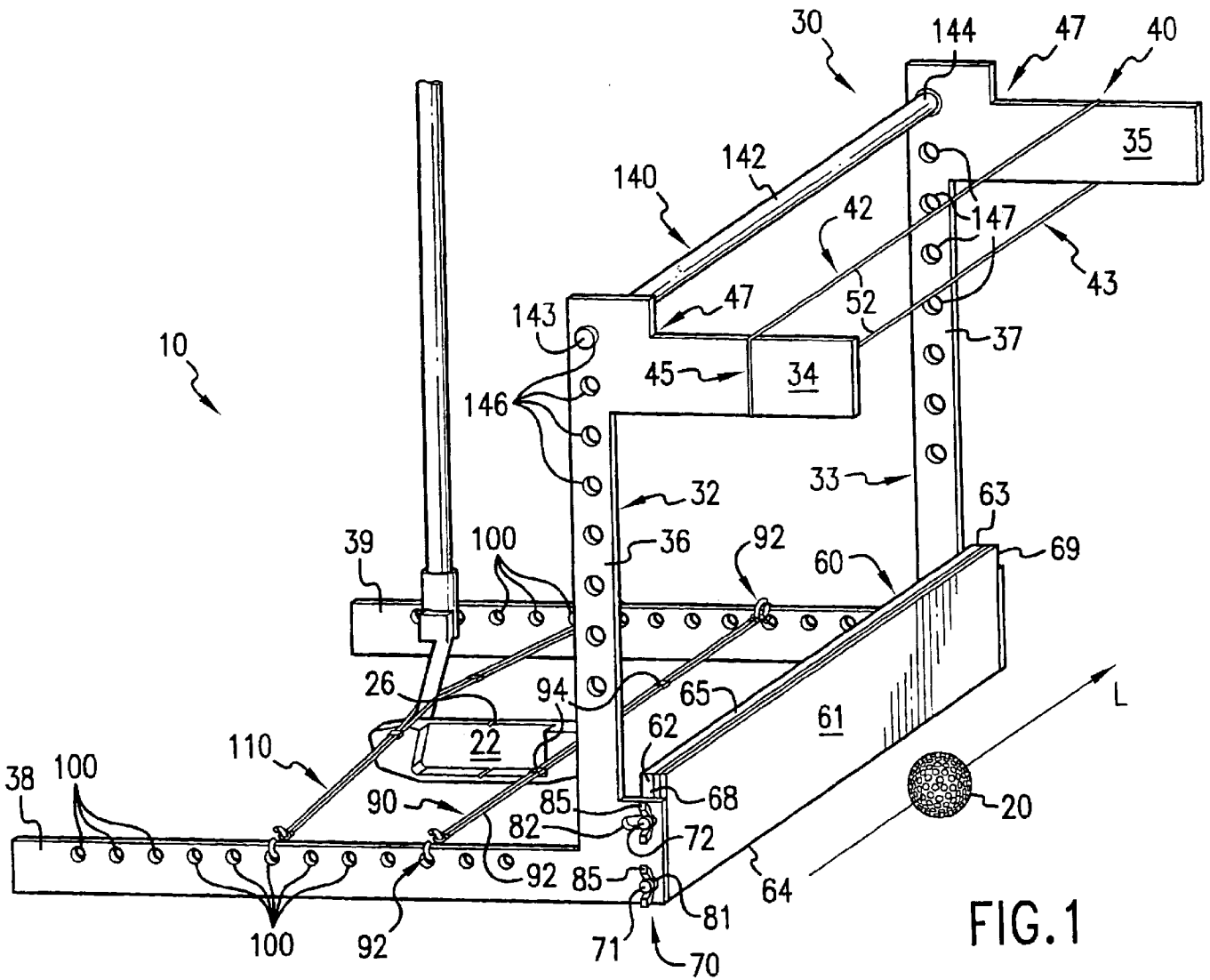
FIG. 1 is a perspective view of an embodiment of the putting trainer according to the present invention.
Figure 3:
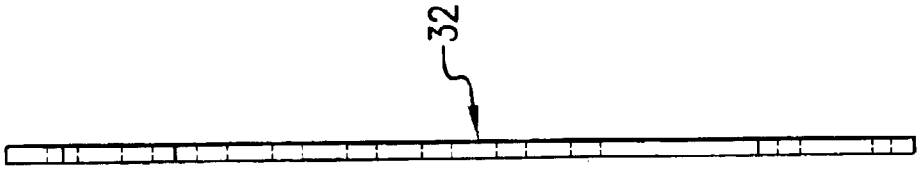
FIG. 3 is a front elevation view of the putting trainer of FIG. 1, particularly illustrating a support leg.

Representative embodiments of the present invention are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural references, the meaning of "in" includes "in" and "on," and the meaning of "within" includes "within" and "on."

Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

Referring now to FIG. 1, the invention provides an apparatus 10 for improving and practicing proper alignment of the golfer's body and golf club during the golf swing. The device may be used with any golf club. In the embodiments described herein, however, the apparatus 10 is particularly useful for practicing and improving the putting stroke. In this specification, the terms "golfer" and "user" are used interchangeably to refer to the user of the apparatus of the invention.

In one aspect, the invention comprises a putting trainer for improving and practicing proper positioning of the golfer's head (not shown) with respect to the golf ball 20. When the golfer stands in the address position with the putter head 22 behind the golf ball 20, the golfer's head is preferably positioned directly above the golf ball 20. Thus, proper positioning of the head is achieved when the eyes are positioned within a vertical plane defined by the golf ball 20 and the line "L" of intended ball travel. The apparatus 10 enables the golfer to practice proper head position by aligning the golfer's eyes (not shown) at an eye location point (not shown) above the apparatus 10 and within the vertical plane that includes the golf ball 20 and the line of intended travel L.

As shown in FIG. 1, the apparatus 10 includes a frame structure 30 having a first support leg 32 and a second support leg 33 spaced from the first support leg. An eye alignment device 40, which is supported by the frame structure 30, includes a substantially linear top edge portion 42 that is visible when viewed from the eye location point, and a tail portion 43 spaced from the top edge portion 42 and located within the same vertical plane as the top edge portion 42. When the user's eyes are located within the vertical plane, at least a selected portion of the tail portion 43 is substantially obscured from view by the top edge portion 42, thus indicating that the user's head is correctly aligned. By contrast, when the user positions his or her eyes outside the above-described vertical plane, both the top edge portion 42 and the tail portion 43 are visible to the golfer. Thus, by positioning his or her head such that the top edge portion 42 is visible, and such that all of the tail portion 43 or some selected portion of the tail portion 43 is hidden from view, the user achieves proper positioning of the head during the putting stroke.

As shown in FIG. 1, in one embodiment the respective first and second support legs 32, 33 of the frame structure 30 comprise portions for supporting the eye alignment device 40. In the illustrated embodiment, the first support leg 32 includes a first arm 34, and the second support leg 33 includes a corresponding second arm 35. The first and second arms 34, 35 are shown in FIG. 1 as extending laterally from the respective support legs 32, 33 of the frame structure, and as being integrally formed with the support legs 32, 33. In other embodiments, the respective arms 34, 35 may be oriented with respect to the support legs 32, 33 in different ways. For example, the arms 34, 35 may extend from the support legs 32, 33 at any desired angle and for any desired length, and may be separately formed and attached to a respective support leg 32, 33 as desired.

In the illustrated embodiment, the eye alignment device 40 comprises a continuous elastic loop 45 passed around the respective first and second arms 34, 35 to form an upper course and a lower course in which the top edge portion 42 comprises the upper course and the tail portion 43 comprises the lower course of the elastic loop 45. The elastic loop 45 is arranged so that the upper course and the lower course are aligned with one another in the vertical plane. To utilize the apparatus 10, the user places a golf ball 20 on the ground adjacent the apparatus 10, and aligns the golf ball 20 in the same vertical plane that includes the upper and lower courses of the elastic loop 45. When addressing the golf ball 20, the user aligns his or her head above the eye alignment device 40 so that the top edge portion 42 and the tail portion 43 are aligned. In the illustrated embodiment, alignment between the edge portion 42 and the tail portion 43 causes the upper course of the elastic loop 45 to obscure the lower course from view, giving the appearance to the user that the elastic loop 45 is a single line. Because the golf ball 20 is aligned in the vertical plane with the eye alignment device 40, the eye alignment device 40 bisects the golf ball 20 when the user's head is properly aligned.

A variety of alternative embodiments are contemplated within the scope of this aspect of the invention. For example, the eye alignment device 40 may be supported by any portion of the frame structure 30. Though the embodiment illustrated in FIG. 1 shows the eye alignment device 40 attached to the first and second arms 34, 35 of the frame structure 30, other attachment points along the frame structure 30, such as the first and second upright members 36, 37 or the first or second base members 38, 39 are also possible and anticipated within the scope of the invention.

In other examples, the eye alignment device 40 may be formed from a variety of structures. The top edge portion 42 and tail portion 43 may be formed from a single piece of material, such as the elastic loop 45 illustrated in FIG. 1, a single piece of flat bar stock (not shown) oriented so that the opposed flat faces are generally aligned in a vertical plane, or formed of some other single piece of a suitable material. Alternatively, the top edge portion 42 and tail portion 43 may be formed from separate pieces of material. In one embodiment, the eye alignment device 40 may be comprised of a plurality of substantially linear indicators 52, each indicator 52 being aligned within the vertical plane that includes the golf ball 20 and the line L of intended travel. Two spaced apart indicators 52 may be utilized to form the eye alignment device 40. In such an embodiment, the top edge portion 42 is the upper indicator 52, and the tail portion 43 is the lower indicator 52.

In the illustrated embodiment, the elastic loop 45 is resilient and may be stretched across the respective first and second arms 34, 35 of the frame structure. The elastic loop 45 is maintained in the selected position on the frame structure 30 by the tension in the expanded elastic. The eye alignment device 40 may also be formed from one or more rubber band(s), string(s), or other flexible members. The eye alignment device 40 may also be resilient or non-extensible. Thus, rope, string, plastic strips or other non-extensible members may form the eye alignment device 40. Alternatively, metals such as steel or aluminum or other rigid materials may form the eye alignment device 40.

In various embodiments, the position of the eye alignment device 40 may be fixed or adjustable as desired by the user. The illustrated embodiment allows the user to adjust the position of the eye alignment device 40. The ability to adjust the position of the eye alignment device 40 with respect to the frame structure 30 may be desirable, for example, if the user wishes use the apparatus 10 with putters of a variety of sizes. As discussed in further detail below, a user may wish to align the heel of the putter with the contact face 61 of the putter alignment member 60 while also utilizing the eye alignment device 40.

As is known, putters having different putter head sizes have different distances before the heel of the putter head and the sweet spot 26 of the putter (where the golfer ordinarily wishes to position the golf ball 20 in his or her stance). Therefore, it may be advantageous to adjust the position of the eye alignment device 40 with respect to the frame structure 30 for different putters. Various adjustable connections between the eye alignment device 40 and the frame structure 30 may therefore be provided, such as hooks, clips, nails, or any conventional fasteners. Apertures, notches or other connection aids may optionally be provided in the frame structure 30 to enable such adjustable connection. Alternatively, the eye alignment device 40 may be fixedly attached to the frame structure 30 at a selected location and orientation, by welding, integrally forming the eye alignment device with the frame structure, or other known means of joining those components.

In embodiments wherein the eye alignment device 40 is adjustable, the frame structure 30 may include a positioning reference 47 for assisting the golfer in placing the eye alignment device 40 in the vertical plane defined by the golf ball 20 and the line L of intended travel. As shown in FIG. 4C, the user may position the putter head 22 so that the heel portion 23 of the putter head contacts the contact face 61 of the putter alignment member 60, which is described in further detail below. When the putter head 22 is positioned in that fashion, the eye alignment device 40 may be positioned within the vertical plane that includes the sweet spot 26 of the putter (which also marks the position of the golf ball 20) and the line L of intended ball travel. In the embodiment illustrated in FIGS. 1 and 4C, the apparatus further includes a positioning reference 47 to assist the user in locating the desired position along the frame structure 30 for the eye alignment device 40.

In the illustrated embodiment, the positioning reference 47 is a notch formed within each of the respective first and second arms 34, 35 of the frame structure 30. The user places the putter head 20 against the frame structure 30 so that the sole surface 25 rests along an upper surface of either the first or second arm 34, 35 of the frame structure 30. In that position, the putter head 22, and thus the sweet spot 26, is immediately adjacent the portion of the frame structure 30 by which the eye alignment device 40 is supported. The user then positions the eye alignment device 40 in the proper position according to the sweet spot 26 of the putter. In the illustrated embodiment, the user would position the elastic loop 45 in the position shown in FIGS. 1 and 4C, so that the eye alignment device 40 is positioned within the vertical plane that includes the golf ball 20, the sweet spot 26, and the line L of intended ball travel. In other embodiments, other structures may form the positioning reference 47.

In another aspect, the invention relates to a putting trainer for improving and practicing a "square" putting stroke. While making a putting stroke, the golfer's chances of making an accurate shot are increased if the putter travels substantially along a plane that includes the line L of intended travel of the golf ball 20. According to this aspect of the invention, and as is known, the putter has a heel portion 23 (FIG. 4C), an opposite toe portion 24, a front face and an opposite rear face, and the putter is held by the golfer such that the heel portion 23 is positioned nearest the golfer's feet (not shown) and such that the golf ball is struck by the front face of the putter head 22. A square putting stroke may be achieved by practicing the putting stroke while resting the heel portion 23 of the putter against a putter alignment member 60, as shown in FIGS. 4C and 4D, so that the putter moves along the contact face 61 of the putter alignment member 60. If the golfer maintains contact between the contact face 61 and the heel portion 23 of the putter throughout the putting stroke, the putter stays within a desired swing plane defined by the contact face 61 (FIG. 1), thus improving the chances of an accurate putt. Therefore, the invention relates to an apparatus for improving a golf stroke by aligning the heel portion of the putter along the swing plane defined by the putter alignment member 60.

One embodiment of the putter alignment member 60 is illustrated in FIG. 1. The putter alignment member 60, which is supported by the frame structure 30, has a first end 62 affixed to the first support leg 32, a second end 63 spaced from the first end 62 and affixed to the second support leg 33, and a substantially planar contact face 61 for contacting the heel 23 (FIG. 4C) of the putter head. The contact face 61 is oriented so that a horizontal line extending along the contact face 61 is parallel to the line L of intended travel of the golf ball 20. When the heel portion 23 of the putter head is moved back and forth in a putting motion with the heel portion 23 received against the contact face 61, the heel portion 23, and therefore the putter head 22, moves within the swing plane defined by the contact face 61.

In one embodiment, the contact face 61 of the putter alignment member 60 has a surface made of a hard plastic material, such as lexan, that is smooth, durable, machinable, has a low coefficient of friction, and is wear resistant. Additionally a contact face 61 that is transparent or translucent affords the opportunity to display instructive markings on the contact face 61, such as indicators for measuring the length of the putting stroke, or any desired decorative or advertising indicia. However, any suitable material may be utilized to form the contact face 61 or the putter alignment member 60, according to the preference of the user.

Many golfers and instructors have different opinions regarding what swing plane is best for the putting stroke. Some believe that a the putting stroke should be confined to a vertical swing plane, so that during the putting stroke, the putter head 22 moves back and forth essentially along the line L of intended travel of the golf ball 20. Golfers refer to this approach by many names, including a "straight back/straight through" putting stroke. Others believe that the swing plane should be inclined from the vertical, so that the putter head 22 moves though an arc within a swing plane that is inclined slightly toward the golfer's head. Under this approach, the putter moves "inside the line" of intended travel L of the golf ball 20 during the putting motion (before and after the putter head 22 strikes the golf ball 20) when viewed from above. Again, there are many other terms for this "inside the line" putting approach.

In one aspect, the apparatus 10 of the invention allows golfers to practice a putting stroke according to either or both of the "straight back/straight through" or "inside the line" approach. To practice a "straight back/straight through" putting stroke, the contact face 61 is oriented so that it defines a substantially vertical plane. To practice an "inside the line" approach, the contact face 61 is oriented so that it defines a plane that is inclined with respect to the ground, so that so that an angle A, illustrated schematically in FIG. 4D, measured between the contact face 61 and the ground along a vertical plane perpendicular to the line L of intended travel of the golf ball is in the range of from about 90 degrees to about 180 degrees. Golfers having different body sizes and putting styles may want different incline angles A for the contact face 61. It has been found that most golfers that prefer an "inside the line" approach prefer an incline angle A in the range of from about 95 degrees to about 120 degrees. One embodiment of the invention provides an incline angle A of about 107 degrees. However, the contact face 61 may be provided at any desired incline angle A depending on the wishes of the golfer using the apparatus. Therefore, any incline angles A in the range of from about 90 degrees to about 180 degrees may be selected without departing from the scope of the invention.

Putter alignment members 60 of varying shapes and sized may be used according to the invention as desired. However, in the embodiment illustrated in FIGS. 1 and 4A–4D, the putter alignment member 60 further defines a bottom edge 64 adjacent the ground, a top edge 65 spaced from the bottom edge 64, a first side edge 68 extending between the top edge 65 and the bottom edge 64, and a second side edge 69 extending between the top edge 65 and the bottom edge 64 and spaced from the first side edge 68.

In one embodiment illustrated in FIGS. 1 and 4A–4D, the apparatus includes an adjustable coupling 70 that is adapted for selectively connecting the putter alignment member 60 to the frame structure 30 so that so that the incline angle A may be selectively adjusted by the user. In one embodiment, the incline angle A may be adjusted to any angle between about 90 degrees and about 120 degrees. In another embodiment, the incline angle A may be adjusted to any angle between about 90 degrees and about 107 degrees. In other embodiments, any range of adjustment desired by the user may be provided.

The adjustable coupling 70 may take any form that allows the user to adjust the incline angle A of the putter alignment member 60, such as devices including hinges, axles, pins, levers, ratchets or other conventional pivoting means. In the illustrated embodiment, which is described by way of example, the adjustable coupling 70 comprises a system of threaded studs, holes and slots that may be adjusted to set the incline angle A.

Figure 2:
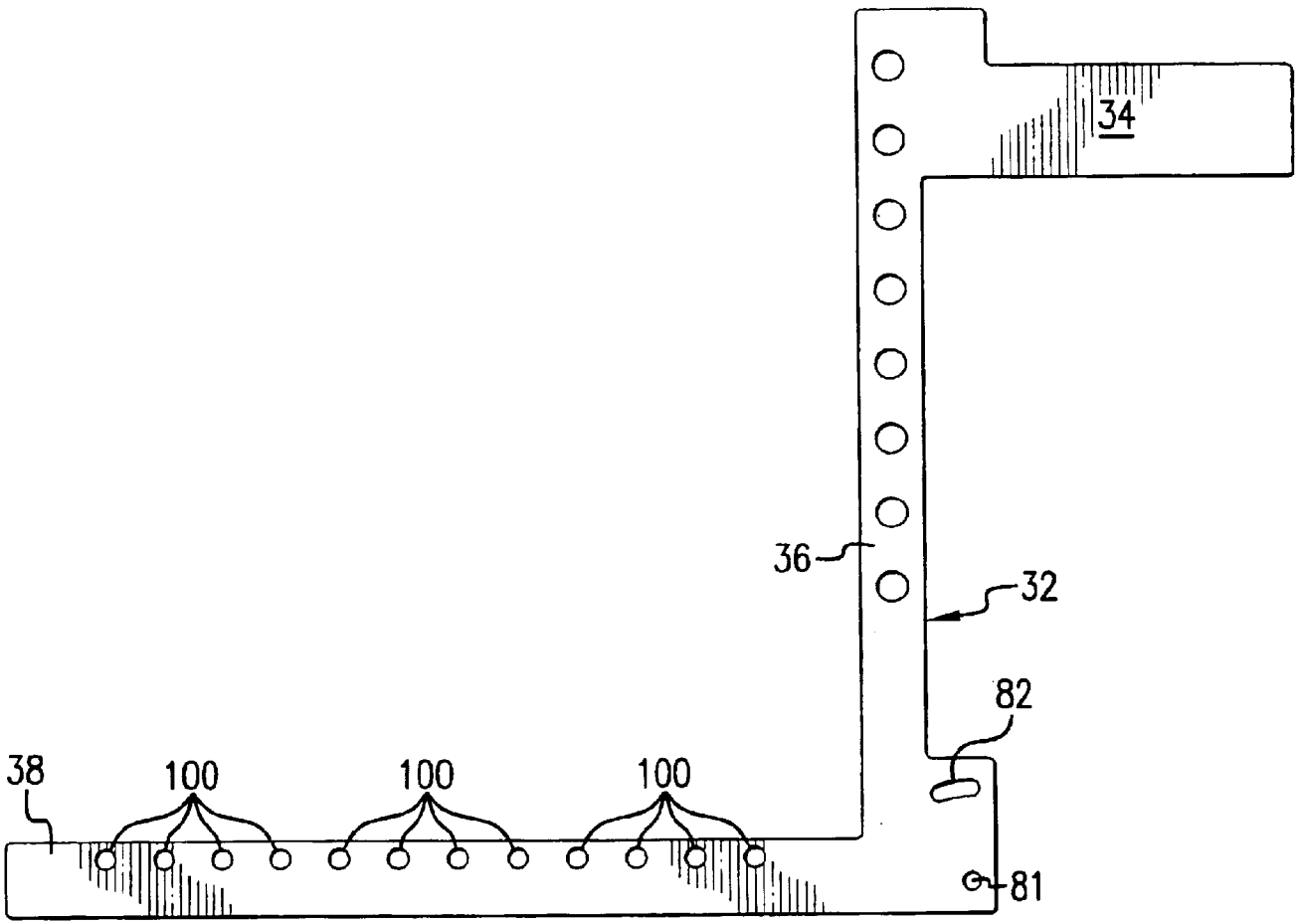
FIG. 2 is a side elevation view of the putting trainer of FIG. 1, particularly illustrating a support leg of the present invention.
Figure 4A:
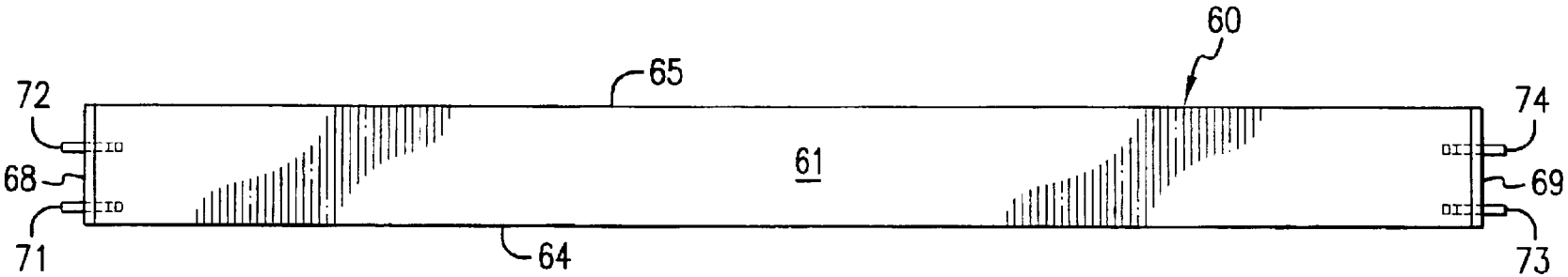
FIG. 4A is a front view of the putting trainer according to FIG. 1, particularly illustrating the putter alignment member.
Figure 4B:
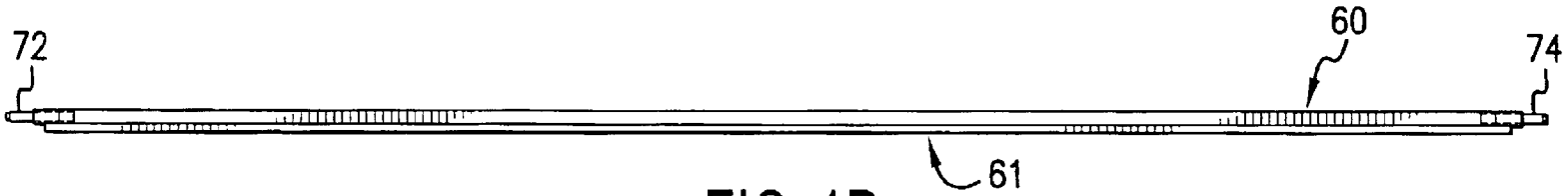
FIG. 4B is a top plan view of the putting trainer according to FIG. 1, particularly illustrating the putter alignment member.
Figure 4C:
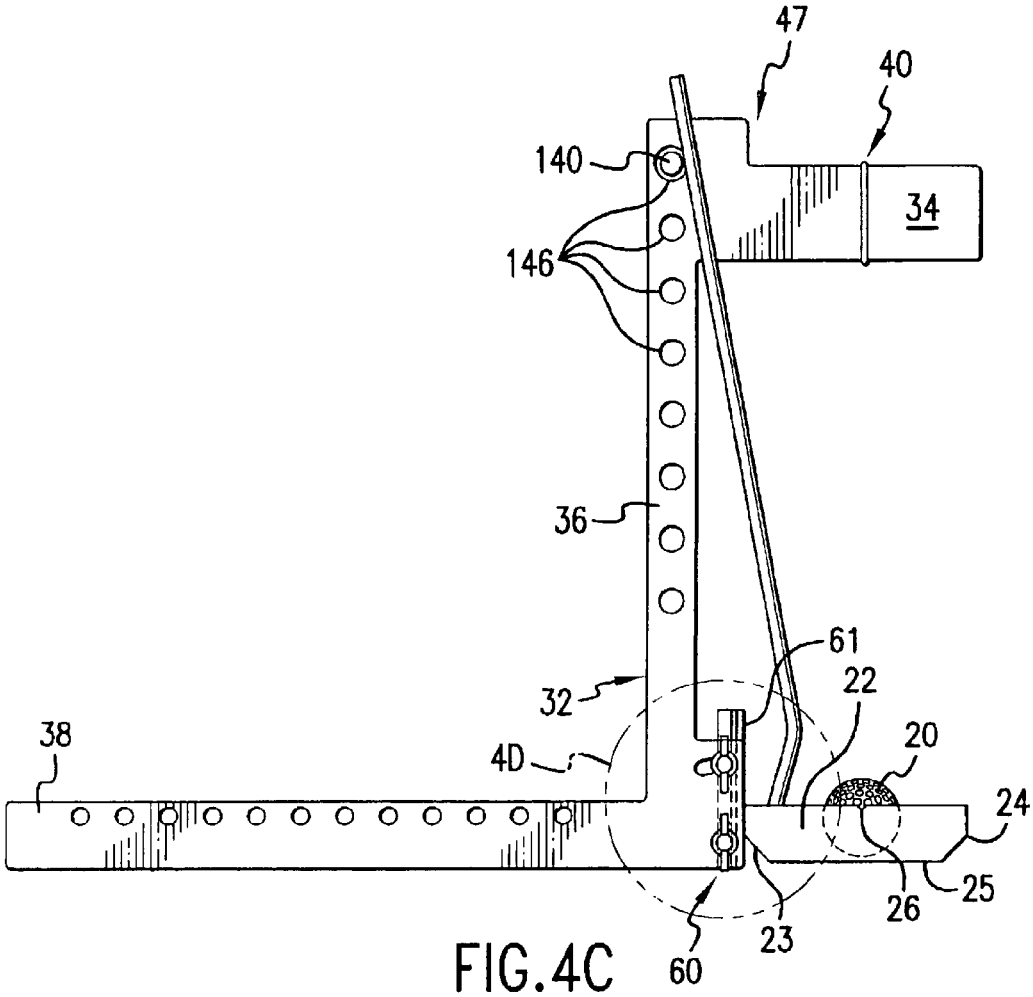
FIG. 4C is a side view of the putting trainer according to FIG. 1, particularly illustrating the putter alignment member.
Figure 4D:
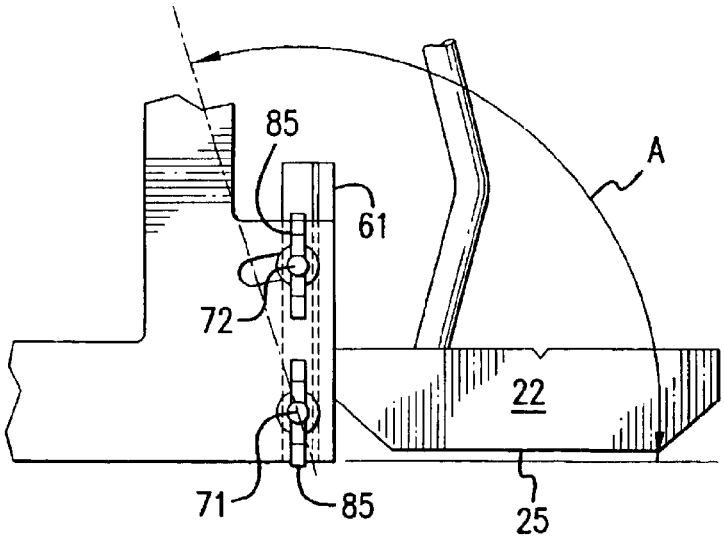
FIG. 4D is an enlarged partial side view of the putting trainer according to FIG. 1, taken along line 4D of FIG. 4C.

As shown in FIGS. 1 and 4A, the illustrated embodiment includes a series of studs, a first lower stud 71 projecting from the first side edge 68 of the putter alignment member 60 adjacent the bottom edge 64, a second lower stud 73 projecting from the second side edge 69 adjacent the bottom edge 64, a first upper stud 72 projecting from the first side edge 68 and spaced above the first lower stud, and a second upper stud 74 projecting from the second side edge 69 and spaced above the second lower stud. As shown in FIG. 2, the first support leg 32 has a first hole 81 sized and shaped to receive the first lower stud 71 therein, and a first slot 82 spaced from the first hole 81 and sized and shaped to receive the first upper stud 72 therein. Similarly, the second support leg 33 defines a second hole (not shown) sized and shaped to receive the second lower stud 73 therein, and a second slot (not shown) spaced from the second hole and sized and shaped to receive the second upper stud 74 therein. The respective studs and slots allow for the selective rotational adjustment of the contact face 61 about the axis extending between the first lower stud 71 and the second lower stud 73. In the illustrated embodiment, each stud engages a corresponding retainer 85 (FIG. 1), illustrated as a hand-operable wing nut, for selectively securing the putter alignment member 60 in engagement with the frame structure 30. Because the studs in the illustrated embodiment are externally threaded, the corresponding retainers 85 in the illustrated embodiment are complementarily threaded to engage the respective studs. The retainers 85 may comprise any suitable and complementarily threaded mechanical fastener.

In various other contemplated embodiments, other devices for selectively fixing the putter alignment member 60 at a selected incline angle A relative to the frame structure 30 are possible. For example, neither studs nor retainers may be required to fix the putter alignment member 60 to the frame structure 30. Alternatively, studs may be constructed that do not require retainers, or studs with engagement mechanisms without threads, including but not limited to collet pins or linch pins. Still other embodiments of the putter alignment member 60 are contemplated according to the invention, and are believed to be within the knowledge of one having ordinary skill in the art, and therefore are not expressly or exhaustively set forth herein.

Figure 5:
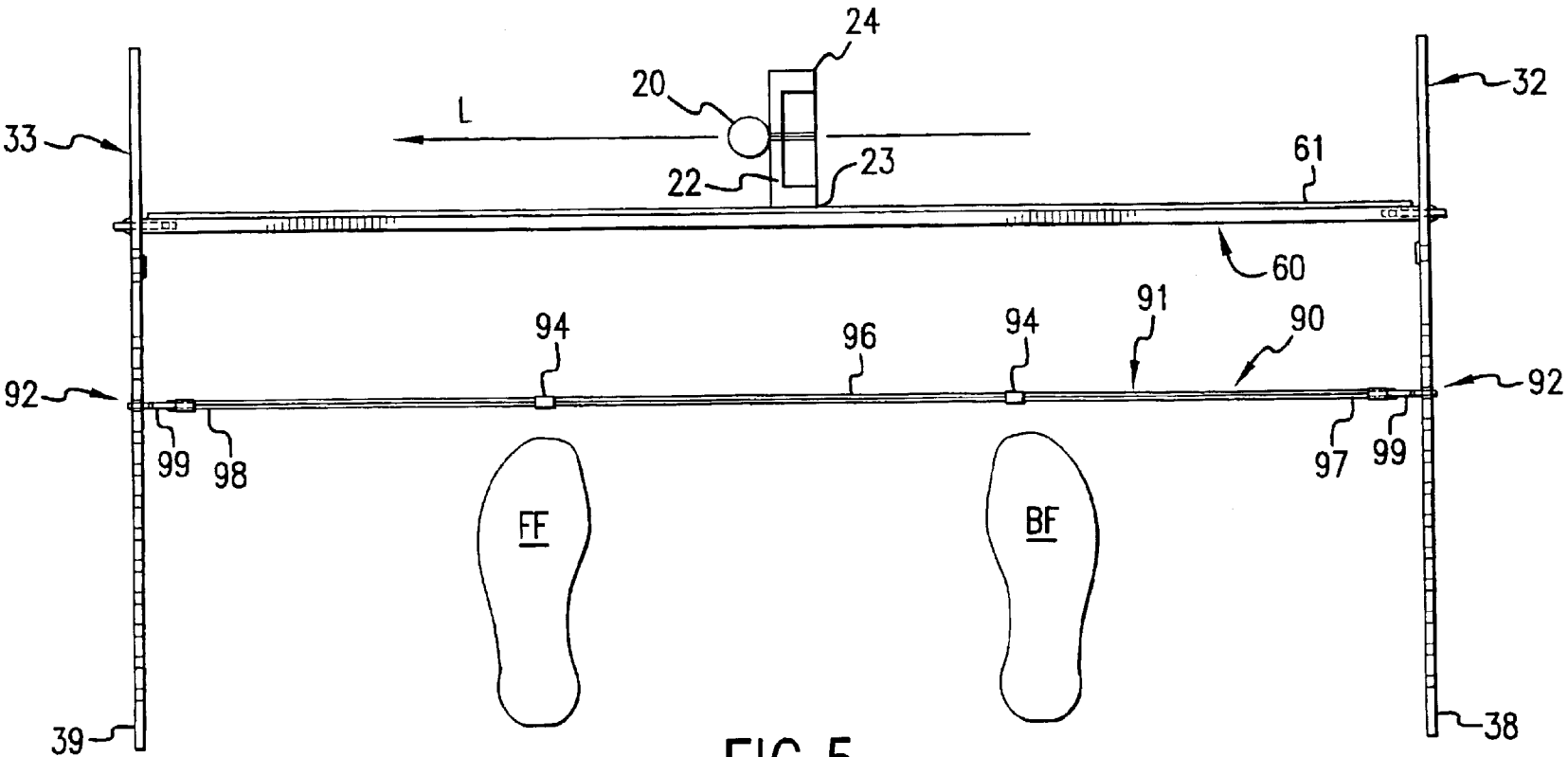
FIG. 5 is a top plan view of the putting trainer according to FIG. 1, particularly illustrating the foot alignment member.

In another aspect, the invention includes an apparatus for improving a golfer's putting stroke by allowing the golfer to align their feet with the intended line L of travel of the golf ball 20. The placement of a golfer's feet during the putting stroke, or the golfer's "stance," is a frequently practiced element of the putting stroke. Referring now to FIG. 5, a stance in which the golfer's front foot "FF" (the left foot for a right-handed golfer, or the right foot for a left-handed golfer) is closer to the line L of intended travel than the golfer's back foot "BF" is referred to as a "closed" stance. The opposite, with the front foot further from the line L of intended travel than the back foot is an "open" stance. In a "square" stance, the golfer's feet are equidistant from the line L. Many instructors and golfers prefer a square putting stance over closed or open stances, but the apparatus of the invention allows the user to practice aligning their feet in any preferred stance.

In the illustrated embodiment, as shown in FIGS. 1 and 5, a stance alignment device 90 is supported by the frame structure 30. The stance alignment device 90 comprises an elongate and substantially linear foot reference indicator 91 extending between the first and second support legs 32, 33 of the frame structure 30. To align his or her feet, the golfer may position their feet so that the tip of each foot is spaced an equal distance from the stance alignment device 90. For example, each foot may be slightly touching, slightly spaced from, or slightly overlapping the stance alignment device 90. The stance alignment device 90 is illustrated in an orientation lying parallel to the line L of intended travel of the golf ball 20. Therefore, the illustrated embodiment is an embodiment that enables the golfer to align his or her feet in a square putting stance. The golfer may adjust the stance alignment device 90 to train with an open or closed putting stance by selectively altering the orientation of the stance alignment device 90 with respect to the line L of intended travel appropriately.

In another embodiment, the stance alignment device 90 of the invention includes at least one connector 92 for permanently or removably connecting the stance alignment device 90 to the frame structure 30. The at least one connector 92 may be any conventional connector, such as the S-hook illustrated in FIG. 1.

In one embodiment, the stance alignment device 90 includes at least one marker 94 (FIG. 5) for indicating a selected position for the golfer's feet during the golf stroke. In the illustrated embodiment, two markers 94 are provided, one marker 94 for each of the golfer's feet. Optionally, one or more markers may be adjustable, so that the user may select the position of the marker(s) 94 along the stance alignment device 90. Such an embodiment enables the user to place a marker 94 at a position along the stance alignment device 90 adjacent the tip of his or her toe, so that the golfer is able to ensure that he or she takes a consistent stance in repeated or subsequent practice sessions. In the illustrated embodiment, two adjustable markers 94 are shown so that the golfer may position an adjustable marker to indicate the position of each foot.

In another embodiment, this aspect of the invention may be combined with the putter alignment member 60 of the invention. In such an embodiment, the apparatus also includes the putter alignment member 60 having a substantially planar contact face 61 oriented so that a horizontal line along the contact face 65 is parallel to the line L of intended travel as described above. Referring now to FIG. 1, the first support leg 32 of the frame member 30 includes a first base member 38, and the second support leg 33 includes a second base member 39, with the stance alignment device 90 affixed to the respective first and second base members 38, 39. The first and second base members 38, 39 are sized and shaped to support the stance alignment device 90 at various selected distances from the putter alignment member 60. Thus, when a golfer practices his or her stance or putting stroke with the heel portion 23 of the putter head 22 resting against the contact face 61 of the putter alignment member 60 (FIGS. 4C–4D), the user can adjust the location of the stance alignment device 90 along the respective first and second base members 38, 39 so that the stance alignment device 90 is positioned adjacent the tips of the golfer's toes (FIG. 5). In this embodiment, the golfer may practice his or her putting stroke using the putter alignment member 60 while simultaneously monitoring their putting stance using the stance alignment device 90.

As illustrated in FIGS. 1 and 5, the stance alignment device 90 includes an elastic cord 96 stretched between two connectors 92, shown as S-hooks 99. The elastic cord 96 has a first end 97, engaging the first base member 38 via a S-hook 99, and a second end 98, spaced from the first end 97, and engaging the second base member 38 via a S-hook 99. In this embodiment, the first base member 38 comprises a portion defining at least one aperture 100 therethrough, the at least one aperture 100 being sized and shaped to receive one or more connectors 92 therein. The second base member 39 also comprises a portion defining at least one aperture 100 therethrough, the at least one aperture 100 being sized and shaped to receive one or more connectors 92 therein.

In other embodiments, any member capable of providing a substantially linear edge, such as a rigid bar, a taut string, cable, wire, or cord, or other conventional means may be utilized for the stance alignment device 90. Various substitutions for the illustrated elastic cord 96 will be apparent to one skilled in the art without departing from the scope of the invention. Similarly, various conventional connectors 92 may be utilized in affixing the stance alignment device 90. Further, while the position of the illustrated stance alignment device 90 is adjustable along the frame structure 30, in other contemplated embodiments, the stance alignment device 90 may be permanently fixed to the frame structure 30 by any conventional means such as welding or permanent attachment by a suitable connector device. The various hardware components or attachment means required to construct an apparatus according to such embodiments are known to one having ordinary skill in the art.

Figure 6A:
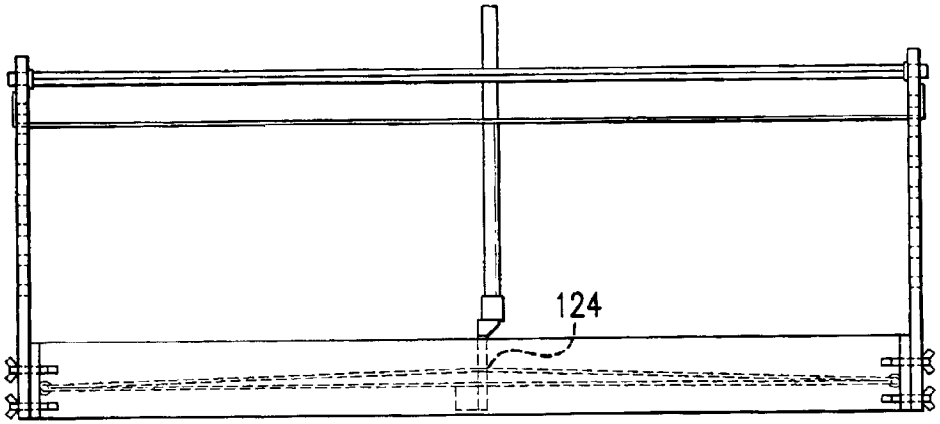
FIG. 6A is a front elevation view of the putting trainer according to FIG. 1, particularly illustrating the stroke resistance device.
Figure 6B:
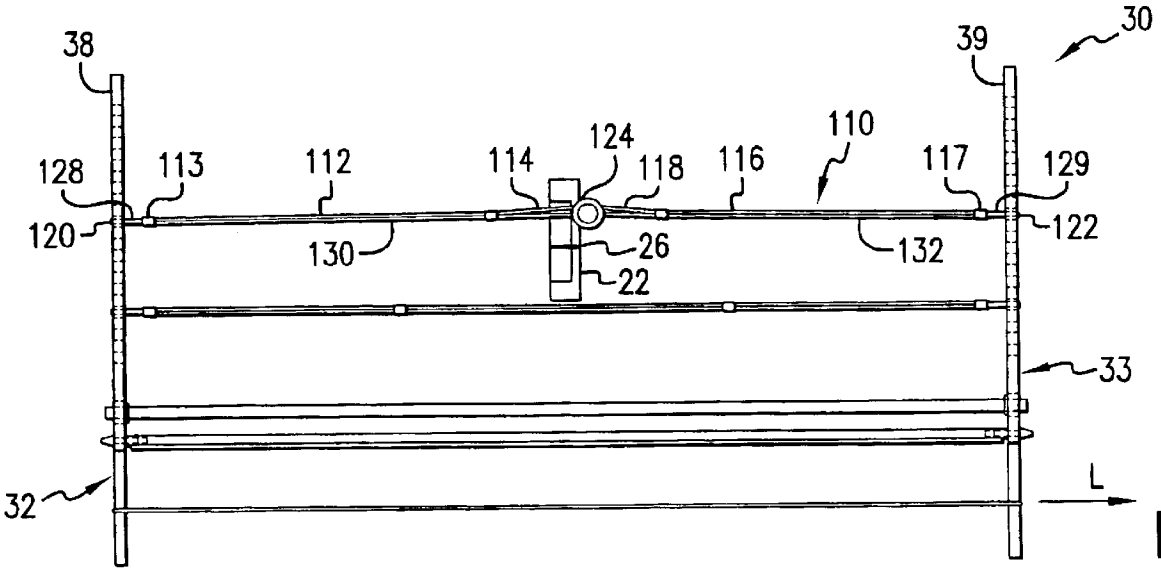
FIG. 6B is a top plan view of the putting trainer according to FIGS. 1 and 6A, particularly illustrating the stroke resistance device.

In yet another aspect, the invention comprises a putting trainer for further improving and practicing a square putting stroke. As shown in FIGS. 1, 6A and 6B, the apparatus 10 includes a stroke resistance device 110 for providing elastic resistance against movement of the putter head 22 in the forward and backward directions along a line parallel to the line L of intended travel of the golf ball 20. By imparting a force to the putter head tending to maintain the putter head along a straight line parallel to the line L of intended travel, the stroke resistance device 10 provides training that supports a "straight back/straight through" putting stroke.

Referring to FIGS. 1, 6A and 6B, the stroke resistance device 110 is supported on the frame structure 30 and includes a first resistance component 112 and a second resistance component 116. The first resistance component 112 has a fixed end 113 (FIG. 6B) and a variable end 114 spaced from the fixed end 113, the fixed end 113 being connected to the first base member 38 at a first fixed point 120 and the variable end 114 being connected to the putter at a connection location 124. The second resistance component 116 also has a fixed end 117 and a variable end 118 spaced from the fixed end 117, the fixed end 117 being connected to the second base member 39 at a second fixed point 122 and the variable end 118 being connected to the putter at the connection location 124.

In use, the user moves the putter head back and forth in a putting motion generally between the respective first and second fixed points 120, 122. During this motion, at least one of the first or second resistance components 112, 116 imparts a tensile force to the putter head toward the respective first or second fixed points 120, 122. If, for example, the golfer moves the putter head out of a "straight back/straight through" motion between the respective first and second fixed points 120, 122 during the putting stroke, the stroke resistance device 110 imparts a net force to the putter head tending to correct the putting stroke by returning the putter head to the line between the respective first and second fixed points 120, 122.

As shown in FIGS. 1, 6A and 6B, when the putter is at rest in the illustrated home position, there is no net force imparted to the putter head by the stroke resistance device 110. The putter is at an equilibrium position and is not being moved by any force or action of the apparatus. When the golfer begins the putting stroke in either the backward (i.e., backswing) direction or the forward (i.e., follow-through) direction along the line between the respective first and second fixed points 120, 122, the stroke resistance device 110 imparts a net force to the putter head that tends to return the putter head toward the address position. Additionally, if during the putting stroke the golfer moves the putter head 22 out of the line of intended ball travel (i.e., if the putting stroke is not square along the "straight back/straight through" path), the stroke resistance device 110 imparts a net force to the putter head that tends to return the putter head 22 to the line between the respective first and second fixed points 120, 122. Thus, the stroke resistance device 110 tends to correct a putting stroke that is not "straight back/straight through" by forcing the putter head 22 back into its proper line.

Additionally, the stroke resistance device 110 may benefit any golfer, regardless of whether they use a "straight back/straight through" or "inside the line" putting stroke. As one example, practice with the stroke resistance device 110 tends to strengthen the user's muscles that are utilized in the putting stroke. The golfer's muscles must overcome the mechanical resistance provided by the stroke resistance device 110 to practice the putting motion. As another example, the mechanical resistance of the stroke resistance device 110 during the backswing and the follow-through tends to train the golfer to avoid "deceleration" of the putter head during the portion of the putting stroke from the furthest part of the backswing to the point of impact. As yet another example, the stroke resistance device 110 tends to train the golfer to maintain a firm and straight wrist position throughout the putting stroke, and to avoid "breaking" or flexing his or her wrists during the putting stroke, especially at or around the point of impact with the golf ball 20.

In the illustrated embodiment, the first resistance component 112 includes a first elastic member 130, and the second resistance component 116 includes a second elastic member 132. The respective first and second elastic members 130, 132 may be any conventional extendible material, such as elastic shock cords as illustrated in FIG. 1, or rubber bands, coil springs, or other resilient elastic members. The elastic members 130, 132 may be provided as continuous loops, as illustrated, or may be single strand members.

Still referring to the embodiment illustrated in FIG. 1, the first resistance component 112 includes a first connector 128 for connecting the first elastic member 130 to the first base member 38, and the second resistance component 116 includes a second connector 129 for connecting the second elastic member 132 to the second base member 39. As described above, the first base member 38 defines a plurality of apertures 100 therethrough, each aperture 100 being sized and shaped to engage the first connector 128. The second base member 39 also defines a plurality of apertures 100 therethrough, each aperture 100 sized and shaped to engage the second connector 129.

In the illustrated embodiment, the respective first and second connectors 128, 129 are conventional S-hooks. Other known, conventional connection means may be utilized according to the invention for releasably or permanently attaching the stroke resistance device 110 to the frame structure 30. The various hardware components or connection means required to construct an apparatus according to such embodiments are known to one having ordinary skill in the art.

As shown in FIG. 1, the stroke resistance device 110 may be utilized in combination with an embodiment of the stance alignment device 90, which is described in greater detail below. In this embodiment, the stance alignment device 90 may be positioned adjacent the putter head 22 to indicate to the user whether they are maintaining the putter head in a "straight back/straight through" motion during the putting stroke.

In yet another aspect, the invention relates to an apparatus for improving a golf stroke by allowing the golfer to practice positioning his or her putter so that the sole surface of the putter is substantially flat upon the ground. Many golfers and instructors believe that by consistently maintaining the putter sole flat with respect to the ground at the address position, the golfer improves his or her chances of making a consistent, repeatable putting stroke.

Figure 7:
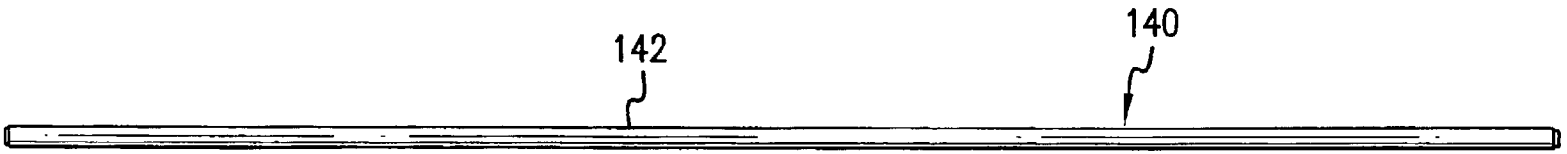
FIG. 7 is a side view of the putting trainer according to FIG. 1, particularly illustrating the shaft alignment device.

Referring now to FIGS. 1, 4C and 7, in this aspect, the invention comprises a putter alignment member 60 that is supported by the frame structure 30. As described in greater detail above, the putter alignment member 60 defines a substantially planar contact face 61 oriented so that a horizontal line along the contact face 61 is substantially parallel to the line L of intended travel. An elongated and substantially linear shaft alignment device 140, which is also adapted to be supported by the frame structure 30, is oriented in a direction substantially parallel to the line L of intended travel. The shaft alignment device 140 is attached to the frame structure 30 at a selected location so that when the heel portion of the putter head is in contact with the contact face 61, and the putter shaft is in contact with the shaft alignment device 140, the sole surface of the putter head is substantially flat upon the ground.

In the illustrated embodiment, the shaft alignment device 140 comprises a substantially cylindrical and elongate rod 142 that extends between the first support leg 32 and the second support leg 33. In other embodiments, the shaft alignment device 140 may be constructed from members having other profiles or cross-section. For example, the shaft alignment device 140 may be a flat bar, a rod having a square or other polygonal cross section, or numerous other cross sections or designs. Additionally, the shaft alignment device 140 may be rigid or non-rigid, and may be fixed or removably connected to the frame structure 30. The shaft alignment device 140 need only present a substantially linear line of contact to maintain the putter shaft in a selected position with respect to the putter head so that the sole surface of the putter head is substantially flat with respect to the ground throughout the putting stroke.

Referring to FIG. 1, in the illustrated embodiment the first support leg 32 comprises a first upright member 36, and the second support leg 33 comprises a second upright member 37. As described below, each of the respective first and second upright members 36, 37 are adapted to engage and support the shaft alignment device 140. The first upright member 36 defines a plurality of openings 146 therethrough, and the second base member 37 similarly defines a plurality of openings 147 therethrough. Each opening 146, 147 may be sized and shaped to receive and engage the shaft alignment device 140. The rod 142 has a first end 143 that engages the first upright member 36 at an opening 146, and a second end 144 spaced from the first end 143 that engages the second upright member 37 at an opening 147. In the illustrated embodiment, the respective first and second ends 143, 144 of the substantially cylindrical rod 142 fit within the respective openings 146, 147 in the first and second upright members 36, 37.

Thus, when using this embodiment of the invention, the user may select or adjust the position of the shaft alignment device 140 to fit a particular putter design. Such adjustable control may be desirable in certain applications because of the variability that exists between various putter designs available to golfers. Putters designed to fit different body sizes and putting styles may have different shaft connection contact angles between the putter shaft and the putter head, so that two different putters may have different angles of alignment between the sole surface of the putter head 22 and the putter shaft. By allowing the user to selectively position the putter alignment device 140 along the first and second upright members 36, 37 of the frame structure 30, the user is able to customize the apparatus 10 for a given putter. As illustrated in FIGS. 4C and 4D, for any selected putter configuration, the shaft alignment device 140 may be positioned along the frame structure 30 so that the putter is supported in a position that allows the sole surface 25 to lie substantially flat along the ground.

Of course, various other embodiments exist within the scope of the invention in which alternative means of supporting the shaft alignment device 140 in its selected location are contemplated. For example, as described in detail above, the position of the shaft alignment device 140 may be selectively adjustable along the frame structure 30. Various conventional devices may be used for providing removable engagement between the shaft alignment device 140 and the frame structure 30. In the illustrated embodiment, one or more O-rings 141 are provided to secure the shaft alignment device 140 to the frame structure. O-rings 141 are shown adjacent the respective first and second ends 143, 144 of the rod 142 inward of the respective first and second support legs 32, 33. Alternatively, O-rings may be provided adjacent the respective first and second ends 143, 144 of the rod 142 outward of the respective first and second support legs 32, 33. In other embodiments, other conventional devices may be utilized, including but not limited to S-hooks, clips, magnetic connections, or other devices that are known to those having ordinary skill in the art. Alternatively, the shaft alignment device 140 may be permanently affixed, by welding or other conventional means, to the frame structure 30.

The various aspects of the present invention have been described individually throughout this specification. As is apparent from the foregoing description and the drawing figures, in various embodiments, one or more aspects of the invention may be embodied in a single embodiment of the apparatus 10. Thus, some embodiments of the invention may include only a single above-described aspect of the invention. Other embodiments may include a plurality of the above-described aspects. The invention is broadly described, however, to include any apparatus that embodies one or more of the aspects of the invention described herein.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An apparatus for improving a golf stroke along a line of intended travel of a golf ball by aligning a user's eyes at an eye location point above the apparatus within a vertical plane that includes the golf ball and the line of intended travel, comprising:

a. a frame structure, comprising a first support leg and a second support leg, each of the first and second support legs having an upright member having an upper and lower end, a base member connected to and generally perpendicular to the lower end of each upright member, and an arm connected to and generally perpendicular to the upper end of each upright member and b. an eye alignment device connected between the arms, comprising:

i. a substantially linear top edge portion that is visible when viewed from the eye location point, and ii. a tail portion spaced from the top edge portion and located within the vertical plane, wherein the linear top edge portion and the tail portion are in proximity to each other, and wherein the tail portion is substantially obscured from view by the top edge portion when the user's eyes are located within the vertical plane.

2. The apparatus of claim 1, wherein the eye alignment device further comprises a plurality of substantially linear indications, each indicator being aligned within the vertical plane that includes the golf ball and the line of intended travel.

3. The apparatus of claim 2, wherein the eye alignment device comprises two spaced and substantially linear indicators.

4. The apparatus of claim 1, wherein the top edge portion comprises a first substantially linear indicator and wherein the tail portion comprises a second substantially linear indicator.

5. The apparatus of claim 4, wherein the first indicator comprises a first elastic portion and wherein the second indicator comprises a second elastic portion.

6. The apparatus of claim 1, wherein the first support leg comprises a first arm and the second support leg comprises a second arm, and wherein the eye alignment device comprises a continuous elastic loop passed around the respective first and second arms to form an upper course and a lower course of the elastic loop, so that the top edge portion comprises the upper course and the tail portion comprises the lower course of the elastic loop.

7. A putting trainer apparatus, comprising:

a frame structure having a first support leg and a second support leg, each of the first and second support legs having an upright member having an upper and lower end, a base member connected to and generally perpendicular to the lower end of each upright member, and an arm connected to and generally perpendicular to the upper end of each upright member;

an eye alignment device having a top edge portion and a tail portion connected to the arms;

a putter alignment member connected to the bases and adjacent the lower end of the upright members;

a stance alignment device connected to the bases;

a stroke resistance device connected to the bases and generally parallel to the stance alignment device; and a shaft alignment device connected to the upper ends of the upright members and being generally parallel to the stance alignment device and the stroke resistance device.

8. The apparatus as claimed in claim 7, wherein the tail portion is substantially obscured from view by the top edge portion when the user's eyes are located within the vertical plane.

9. The apparatus as claimed in claim 8, wherein the eye alignment device is a continuous elastic loop wrapped around the arms.

10. The apparatus as claimed in claim 7, wherein the puffer alignment member comprises:

a bottom edge adjacent to a ground surface, a top edge spaced from the bottom edge, a first side edge between the top edge and the bottom edge, and a second side edge between the top edge and the bottom edge and spaced from the first side edge; and an adjustable coupling having a first lower stud projecting from the first side edge of the putter alignment member adjacent the bottom edge and engaged with a first hole located adjacent the lower end of the respective upright member, a second lower stud projecting from the second side edge adjacent the bottom edge and engaged with a second hole located adjacent the lower end of the respective upright member, a first upper stud projecting from the first side edge and spaced above the first lower stud and engaged with a first slot located adjacent the lower end of the respective upright member and spaced from the first hole, and a second upper stud projecting from the second side edge and spaced above the second lower stud and engaged with a second slot located adjacent the lower end of the respective upright member and spaced from the second hole.

11. The apparatus as claimed in claim 7, wherein the stance alignment device comprises an elongate foot reference indicator having at least one adjustable marker moveable along the foot reference indicator.

12. The apparatus as claimed in claim 7, wherein the stroke resistance device comprises a first resistance component, having a fixed end and an variable end spaced from the fixed end, the fixed end being connected to the first base member at a first fixed point and the variable end being connected to the putter at the connection location, and a second resistance component, having a fixed end and a variable end spaced from the fixed end, the fixed end being connected to the second base member at a second fixed point and the variable end being connected to the putter at the connection location.

13. The apparatus as claimed in claim 7, wherein the shaft alignment device is a substantially cylindrical and elongated rod having a first end engaging the first upright member and a second end engaging the second upright member that is spaced from the first end.

14. A putting trainer kit, comprising:

a putting trainer apparatus, comprising a frame structure having a first support leg and a second support leg, each of the first and second support legs having an upright member having a plurality of openings and having an upper and lower end, a base member having a plurality of apertures and connected to and generally perpendicular to the lower end of each upright member, and an arm connected to and generally perpendicular to the upper end of each upright member;

a continuous elastic loop adapted to be wrapped around the arms to form an eye alignment device;

at least one elongate elastic band adapted to be connected between the bases to form at least one of a stance alignment device and a stroke resistance device;

an elongated rod adapted to connect between the upright members to form a shaft alignment device;

a golf club adapted to interact with the apparatus; and a golf ball adapted to be aligned with the apparatus.

15. The kit as claimed in claim 14, wherein the golf club is a putter.

16. The kit as claimed in claim 14, further comprising a putter alignment member having a planar contact face connected between the upright members at the lower ends, the putter alignment member being pivotally connected to the frame to adjust the planar contact face between an orientation generally parallel to the upright members to an orientation angled with respect to the upright members.

* * * * *